United States Patent [19]

Summers et al.

[11] Patent Number: 4,534,481

[45] Date of Patent: Aug. 13, 1985

[54] SNAP-ON, TAMPER-EVIDENT CONTAINER CLOSURE

[75] Inventors: Kenneth L. Summers, Angola; Gary M. Baughman, Auburn, both of Ind.

[73] Assignee: Rieke Corporation, Auburn, Ind.

[21] Appl. No.: 636,910

[22] Filed: Aug. 2, 1984

[51] Int. Cl.[3] ..... B65D 41/48; B65D 41/32

[52] U.S. Cl. ..... 215/253; 215/255; 215/256; 215/321

[58] Field of Search ..... 215/254, 250, 253, 255, 215/256, 305, 317, 321; 220/265, 266, 306, 356

[56] References Cited

U.S. PATENT DOCUMENTS

| | | | |
|---|---|---|---|
| 3,462,035 | 8/1969 | Grussen | 215/41 |
| 3,690,499 | 9/1972 | Westfall et al. | 215/40 |
| 3,820,678 | 6/1974 | Zipper et al. | 215/253 |
| 3,866,784 | 2/1975 | Beck | 215/321 |
| 3,902,621 | 9/1975 | Hidding | 215/252 |
| 3,952,901 | 4/1976 | Conti | 215/251 |
| 3,976,215 | 8/1976 | Smalley | 215/253 |
| 3,986,627 | 10/1976 | Zapp | 215/305 X |
| 4,197,960 | 4/1980 | Walter | 220/266 |
| 4,227,619 | 10/1980 | Magnusson | 215/255 |
| 4,230,229 | 10/1980 | Crisci | 215/253 |
| 4,320,843 | 3/1982 | Dubach | 215/256 |
| 4,326,649 | 4/1982 | Marino et al. | 220/306 x |

*Primary Examiner*—Steven M. Pollard

*Attorney, Agent, or Firm*—Woodard, Weikart, Emhardt & Naughton

[57] ABSTRACT

A flexible, snap-on closure for use in combination with a container neck in order to seal closed a container in a tamper-evident manner includes a flexible closure having a top surface, a cylindrical side wall, an inwardly protruding annular rib and an inwardly opening annular channel. The container neck is compatibly configured with a top rim defining the container opening and an outwardly opening annular channel disposed below the top rim such that the annular rib is configured to fit within the outwardly opening channel and the inwardly opening annular channel is configured to snugly receive the top rim. The closure further includes a bail handle attached to the side wall by means of two attachment ribs which are integral with the bail handle. The side wall of the closure includes score lines, there being one line on opposite sides of each attachment rib, such that upward lifting on the bail handle which is attached to the side wall by means of three frangible elements, results in the breaking of those frangible elements and the severing of the score lines such that the lower portion of the closure side wall is flared outwardly in order for the closure to be removed from the container neck. The closure has an increased axial height which is sufficient relative to its diameter to prevent removal of the closure without some disruption of the closure.

12 Claims, 6 Drawing Figures

SNAP-ON, TAMPER-EVIDENT CONTAINER CLOSURE

BACKGROUND OF THE INVENTION

This invention relates in general to plastic closures for containers and more particularly to such closures which are designed for snap-on assembly and which include a tamper-evident feature.

The container closure art is quite crowded with numerous styles of closures, many with very limited and specialized purposes. One small segment of that art includes those closures which are intended to cooperate with the corresponding container, not by threaded engagement, but rather by snapping onto the neck of the container. So long as the mutually engaging portions have a correct size and positional location, a very tight and secure seal can be established without the need for threaded engagement.

Another segment of the closure art which is applicable to threaded engagement closures as well as snap-on closures includes those closures with some type of tamper-evident feature. A tamper-evident feature is used to alert the end user or recipient of the container that the contents may have been tampered with at some earlier point in time. By constructing a closure which cannot be defeated for access to the contents of the container without showing that it has been defeated or at least tampered with, the end user or recipient is assured that the contents are unaltered if the closure does not reveal any tampering. Concerns over tampering are solved by means of the present invention which offers a snap-on, pull-off closure which cannot be defeated as initially applied to the container, for access to the container contents, without showing, by the appearance of the closure, that tampering has occurred. The present invention includes a bail handle attached to the body of the closure by means of attachment ribs which are bounded by a pair of score lines (one adjacent each rib) disposed on the inside of the closure body skirt. The increased axial height of the closure relative to its diameter in combination with an abutment surface on the container neck assures that the closure cannot be pried off without showing evidence of such prying attempts. If prying off of the closure is attempted, the score lines will be partly severed or the lower edge of the closure marred or torn, all of which reveal that an attempt to tamper with the container contents has been made. Further, by disposing the majority of the bail handle at a location continguous to the lower edge of the container body, and by attaching this bail handle to the container body by means of a plurality of frangible elements, any attempt to pry off the closure will by necessity push upwardly on the bail handle, causing one or more of the frangible elements to fracture, thereby indicating that an attempt has been made to tamper with the contents of the container.

When it is intended to remove the closure of the present invention from the neck of the container, the bail handle is pulled upwardly thereby severing each of the frangible elements and with continued pulling in an upward direction, the attachment ribs act to sever the score lines and thereby allow the lower portion (skirt) of the closure body to flare outwardly, effectively increasing its diameter, thus enabling the closure to be pulled off of the container neck.

While certain prior art references exist, none are believed to anticipate nor to render obvious the present invention. However, it may be deemed that one or more of such references are relevant to the present invention and thus these various references are set forth below.

| U.S. Pat. No. | Patentee |
|---|---|
| 4,230,229 | Crisci |
| 3,902,621 | Hidding |
| 3,952,901 | Conti |
| 4,227,619 | Magnusson |
| 4,320,843 | Dubach |
| 3,976,215 | Smalley |
| 4,197,960 | Walter |
| 3,462,035 | Grussen |
| 3,690,499 | Westfall et al. |

Crisci discloses a snap-on bottle cap for a container having a neck configuration which includes an annular shoulder over which the bottle cap is engaged so as to be self-retaining thereon. The bottle cap is formed of resilient material permitting distortion of the cap when it is applied to the bottle. A ring is positioned around and fastened to an annular flange of the cap by a plurality of frangible elements and it is attached to a portion thereof separated from the remainder by spaced cutaway areas. The ring thus may be used as a pull ring to free the portion of the annular flange as necessary in removing the cap by permitting the remainder of the cap to expand circumferentially so as to become disengaged from the annular shoulder on the neck portion of the bottle.

Hidding discloses a tamper-proof cap structure which includes a cap, a locking ring and a handle and is intended for use with a bottle or similar container having one or more teeth fashioned adjacent a reduced bottle neck. The cap structure locking ring is provided with one or more pawls positioned to mate with the container neck teeth to prevent the cap from being unscrewed from the container. Frangible connectors which rigidly connect the locking ring and cap can be broken if sufficient unscrewing torque is applied to the cap; and the broken connectors and dropped ring provide visual evidence that tampering has at least been attempted.

Conti discloses an overcap for receipt on a jar in surrounding relation to a threaded closure cap of the jar and which when mounted prevents tampering with the closure cap and unauthorized entry into the jar interior. The overcap includes an upper surface overlying the closure cap and a skirt depending circumferentially therefrom. The skirt is radially spaced from the closure cap substantially along its length so that the overcap is free for rotational movement relative to the closure cap and cannot be frictionally coupled to the closure cap to effect removal of the latter.

Magnusson discloses a tear tab closure for containers which comprises a cap having a top, a downwardly depending skirt, a tear tab projecting from the skirt and terminating in a finger ring. The tear tab is relatively short and the finger ring is secured thereto by any suitable mechanical or adhesive fastening means. The finger ring has a large enough inside diameter to facilitate capture of the finger ring by a finger of the user and it may be disposed to lie at the side of the container or it may be large enough in diameter to encircle the container in close proximity thereto. Dubach discloses closure means for a bottle for hermetically sealing the bottle. The disclosed closure means is shaped like a cap comprising at least one slitting by means of which the side wall of the cap spreads when being set. The cap furthermore comprises an inside annular bead and a sealing collar for hermetically sealing the cap onto the bottle. The cap further comprises a lift-off element for easy reopening and at least one tear-off tensioning member spanning the slitting so as to counteract spreading and acting as a warranty signet.

Smalley discloses a tamper-indicating, press-on, pull-off closure for maintaining pressure in a container whereby the closure and container provide a package which may be readily opened by a customer without the use of tools and without the creation of dangerous sharp edges. This closure includes a cap and a cap liner which fits within the cap and is formed integral with a pull ring for removal of the cap from a container. A plurality of severable tamper-indicating webs are formed between the pull ring and the cap liner and sever upon actuation of the pull ring to indicate tampering with the package.

Walter discloses a tamper-proof cap and neck assembly which are made of stretchable plastic material in which the neck has portions fitted within and about a short metal neck portion of a container which serves as a rigidifying back-up for the plastic neck. A locking shoulder on the neck provides a deflection-resistant structure and thereby prevents a tamper-indicating ring connected to the cap from slipping off the shoulder without tearing upon initial unthreading of the cap. This rigidified structure also facilitates application of the tamper-indicating ring during initial threading of the cap onto the threaded neck at which time the ring is stretched over the shoulder by a capper bead which engages force-transmitting posts integral with the ring for forcing the ring over the locking shoulder.

Grussen discloses a one-piece plastic bottle cap which comprises a crown-shaped main part encircled by a reinforcing ring which holds the main part on the bottle and is integral therewith over a 60° sector, but may be swung upwardly and used to pull the cap off the bottle. The cap has two depending skirts and the inside of the outer skirt is provided with retaining means for engagement over the peripheral ridge on the mouth of a bottle.

Westfall discloses a composite closure which includes a flexible, resilient plastic fitment, and a gasketed rigid closure panel. The fitment has a perforate top and dependent skirt. The closure panel is retained within the skirt. A lifting ring in the top of the flexible plastic fitment is joined to marginal portions of the fitment top by breakable bridging portions and by substantially unbreakable integral hinge portions attached directly to a portion of the skirt. Once breakable bridging portions are broken, the semi-detached ring serves to alert shoppers that the closure has been previously tampered with or removed.

While many of the intended purposes for the listed references are much the same, and in part similar to the intended purpose of the present invention, it is to be noted that the novelty of a device is not based upon its intended purpose, but rather on its uniqueness of structure employed to accomplish the particular purpose. Further, none of the disclosed devices rely on an increased axial height of the closure in order to preclude the ability to manually remove the closure from the container neck by pulling or twisting the closure off, a technique which is available with those closure designs of a limited axial height. As should be understood, when the axial height of a snap-on, flexible closure is somewhat small with respect to the diameter of the closure, then the side wall of the closure may be deflected outwardly to a sufficient degree in order to clear the top rim of the container neck thereby allowing the closure to be removed. If tamper-evident means are disposed as part of the closure they may not disclose any tampering depending upon their type and location. Due to the fact that such closures are typically fabricated from a flexible synthetic material, if only a minimal amount of side wall flexing is required in order to sufficiently distort the closure so that it may be removed from the container, then it is likely that any frangible elements or other tamper-evident features will not be broken or severed by this minimal amount of flexing. For this reason, the closure of the present invention has an increased axial height, and relative to the diameter size of the closure, a minimal amount of flexing is not sufficient to break or sever the frangible elements and is not sufficient to distort the side wall of the closure sufficiently for removal from the container neck. Any amount of flexing or distortion of the side wall of the closure that would enable its removal from the container neck would by necessity according to the present invention's design result in tearing of the side wall, breaking of the frangible elements connecting the bail handle to the side wall or partial severing of the score lines which are disposed in the side wall of the closure.

The concept of increasing the axial height of a snap-on closure in order to prevent prying off of the closure without detection is a concept that is completely novel. Another novel feature of the present invention includes a primary seal design that enables the normal cap liner to be eliminated.

SUMMARY OF THE INVENTION

A flexible, plastic snap-on closure for use in combination with a container neck in order to seal closed the container in a tamper-evident manner according to a typical embodiment of the present invention comprises a flexible cap body having a top surface and a generally cylindrical surrounding side wall, an inwardly protruding annular rib, an annular connection portion disposed between the annular rib and the top surface and arranged to define an inwardly opening annular channel, a bail handle attached to the surrounding side wall by means of two spaced-apart attachment ribs which are integral with the bail handle wherein the side wall has a pair of score lines, each score line disposed adjacent a corresponding attachment rib, and wherein the closure has an increased axial height which is sufficient relative to its diameter size and flexibility to prevent defeat of the closure without some indication resulting on the closure that tampering has occurred.

One object of the present invention is to provide an improved snap-on, tamper-evident container closure.

Related objects and advantages of the present invention will be apparent from the following description.

DESCRIPTION OF THE PREFERRED EMBODIMENT

Figure 1:
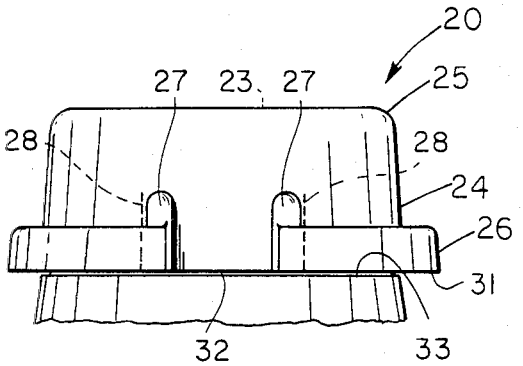
FIG. 1 is a front elevation view of a snap-on, tamper-evident container closure as received on a container neck according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being comtemplated as would normally occur to one skilled in the art to which the invention relates.

Figure 2:
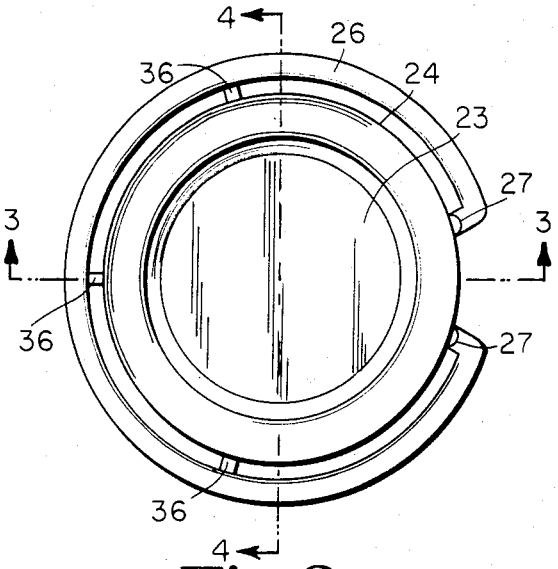
FIG. 2 is a top plan view of the FIG. 1 container closure.

Referring to FIGS. 1 and 2, there is illustrated a snap-on, tamper-evident container closure 20 as disposed on a container neck 21. The container closure includes a substantially flat though recessed top surface 23 (see FIG. 3), a generally cylindrical surrounding side wall 24, and a connecting portion 25 which is annular in configuration and extends between top surface 23 and the generally cylindrical side wall 24. Integrally disposed as part of closure 20 is a bail handle 26 which extends circumferentially about side wall 24 at a location which is contiguous to the lower edge of side wall 24. The bail handle 26 does not extend completely around the side wall but rather terminates short of a 360° extension with each end of the bail handle terminating in a corresponding and axially-extending integral attachment rib 27. Providing an interface between the two attachment ribs 27 and the side wall 24 are two score lines 28 which are arranged in a parallel manner, a different one adjacent each attachment rib, and disposed on the outer side of the rib rather than between the two ribs. These score lines represent portions of side wall 24 which have a reduced thickness thereby enabling the score lines to be one of the first portions to fracture or sever as bail handle 26 is pulled upwardly. The reduced thickness is achieved by elimination of material from the inside diameter surface of the side wall, leaving the outside surface uninterrupted. As was previously mentioned, the lower edge 31 of bail handle 26 is generally coincident with lower edge 32 of the side wall 24. In the received condition as is illustrated in FIG. 1, the container neck 21 includes a shoulder 33 which, although slightly angled, is disposed in extremely close proximity to lower edge 32. This shoulder is properly located in the axial direction such that the closure 20 may be pushed downwardly onto container neck 21 with a snapped-on and sealed engagement resulting, while at the same time, lower edge 32 is pushed to a location adjacent shoulder 33. The proximity of shoulder 33 to edge 32 and the outside diameter size of shoulder 33 precludes vertical access by a pointed instrument inbetween the closure and container neck. For molding and handling convenience, shoulder 33 may be replaced by a bead, but so long as its size and location are equivalent to shoulder 33, the tamper-evident aspects of the design remain unaffected.

Figure 3:
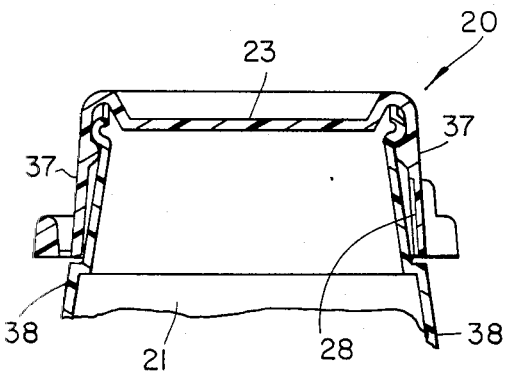
FIG. 3 is a front elevation view in full section of the FIG. 1 container closure as disposed on a container neck.

As is illustrated in FIG. 2, the bail handle 26 is attached at three other locations to the side wall 24. These points of attachment are provided by frangible elements 36 which are broken as the bail handle 26 is pulled upwardly as part of the closure removal procedure. These frangible elements provide yet one further indicator of any tampering attempts which one may make against the container. If one attempts to tamper with the disclosed container closure and elects to use the bail handle, the first elements to be broken will be these frangible elements 36 and due to their spacing around the circumference of the closure, there is in effect no portion of the bail handle which may be lifted up upon sufficiently to remove the closure without one or more of the frangible elements breaking. As the bail handle continues to be lifted upwardly upon, and after the three frangible elements are broken, the score lines which bound each of the attachment ribs will be severed. When such severing takes place, the approximate lower half of the closure side wall becomes disrupted allowing it to flare outwardly so that the closure may be removed from the container neck. As is illustrated, the two attachment ribs extend in an axial direction upwardly across the side wall 24 of the closure for approximately half of the axial height of the closure. By constructing closure 20 such that its side wall is of an increased axial height, the lower portion of the side wall cannot be deflected outwardly a sufficient degree for the closure to be removed from the container neck without one or more of the tamper-evident features being broken. A further aid provided by the present invention for keeping the closure on the container neck until it is desired to be removed is the fact that the radial width of the shoulder 33 is approximately equal to the thickness of side wall 24. Consequently, the outer surface of side wall 24 is generally in circumferential alignment with the outer surface of the container neck 21 at a location below shoulder 33. This is best illustrated in FIG. 3 wherein outer wall surface 37 of side wall 24 is generally in alignment with outer surface 38 of container neck 21.

When the bail handle is lifted upwardly on and the pair of score lines severed, the effect is to allow the skirt portion of the side wall to flare outwardly which has the effect of reducing the axial height of the closure. In fact, the axial height is approximately cut in half and as a result, the axial height dimension relative to the diameter of the closure becomes acceptable for pulling the container closure off of the container neck. Even if one would attempt to gain access to the contents of the container by inserting a tool or other sharp object between the lower edge 32 and shoulder 33, it is not possible to pry outwardly on the side wall a sufficient distance to allow the closure to be pried off of the container neck without at the same time some damage being done to the side wall at the location where the prying occurred. Such a prying attempt would also cause some lifting of the bail handle which could fracture one or more of the frangible elements. Although the synthetic material used for the closure is flexible, it may still be torn, cut or otherwise marred which would in fact be the result from such a prying attempt. Consequently, even if one does not elect to use the bail handle due to its revealing that a tampering attempt has taken place by the fracturing of the frangible elements 36, evidence will still be left behind as to the tampering attempt simply by the marks and disruptions caused to the side wall 24 of closure 20.

While closure 20 may not appear to be significantly higher than other caps, the difference to be noted is between caps which are threadedly attached to the container neck and those closures which snap onto the neck. For threaded engagement a greater axial height is needed, depending on the thread pitch simply to provide enough threads. However, with snap-on closures the only axial height ever considered was just enough to provide some means of engagement for the snapping together. Thus the present invention is a clear departure from these traditional designs.

The concept of an increased axial height becomes relevant when it is understood that prying off of the closure is as logical to one who is tampering as is lifting up on a bail handle which would immediately reveal that tampering had occurred. As one lifts upwardly on the outer, lower edge of the closure the distance from the lower edge to the top edge of the container rim represents one leg of a right triangle (the height). The diameter of the closure provides the other leg (the length). The angle of this triangle which is opposite the height side is the amount of upward deflection needed to pry the closure off of the container. Simple experiments with the geometry and dimensional values reveal the importance of an increased axial height as an appropriate tamper-evident means for snap-on plastic closures.

Although one aspect of the present invention is the tamper-evident features and the design of the closure which has an increased axial height to prevent prying of the closure off of the container neck without some evidence of that prying being disclosed, another feature of the present invention is the snap-on design and the interior seal which is created by the closure being snapped onto the container neck.

Figure 5:
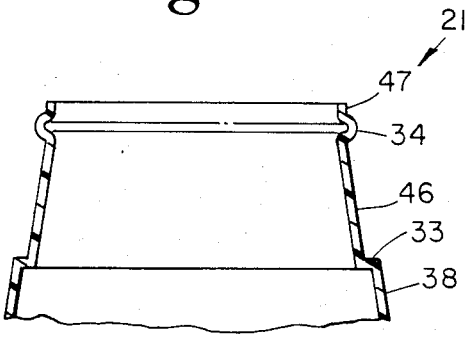
FIG. 5 is a front elevation view in full section of the FIG. 1 container neck.
Figure 4:
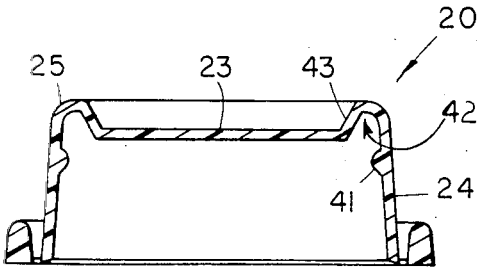
FIG. 4 is a front elevation view in full section of the FIG. 1 container closure.
Figure 4A:
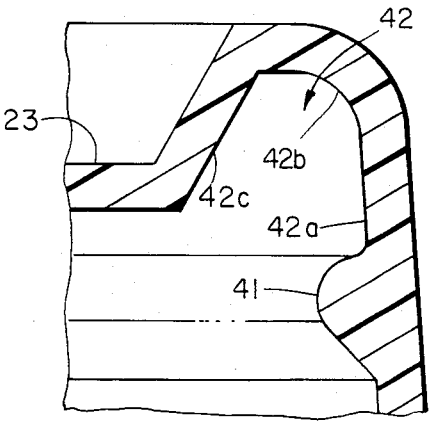
FIG. 4A is an enlarged detail of a channel which comprises part of the snap-on capability of the FIG. 1 container closure.

Referring to FIG. 3 which is a full section view of the assembly of the closure onto the container neck and FIGS. 4 and 5 which are full front elevation section views of the closure and the container neck, respectively, it will be seen that the upper portion of both members are specifically configured with male and female portions so as to create a snap-together assembly which provides an adequate seal for the contents of the container. Referring to FIG. 4, closure 20 includes an inwardly protruding annular rib 41 which has a slightly rounded interior surface. Connecting portion 25 which connects the side wall 24 with top surface 23 as well provides the connecting portion between annular rib 41 and top surface 23. Connecting portion 25 is configured in such a manner so as to define a downwardly and inwardly opening channel 42. Due to the recessed nature of top surface 23, one side 43 of connecting portion 25 is disposed as a downwardly and inwardly inclined surface. This particular geometry results in channel 42 having a cross section shape which is part-circular and extends in a circular manner for approximately 90 degrees. There is a substantially flat, vertical portion **42*a* leading from rib 41 to the start of the circular portion 42*b*. The channel ends with a substantially flat portion 42*c* which is disposed at approximately 45 degrees and connects to the underside of top surface 23**.

Referring to container neck 21, it is arranged into two generally cylindrical though slightly tapered portions, that portion above shoulder 33 and below bead 34, and that portion above bead 34. The outer surface 38 of the portion below shoulder 33 does not comprise a functional part of the closure and container combination, although it should be understood that the outside diameter size of surface 38 relative to the outside diameter size of wall 46, each at the location of shoulder 33, determines the radial dimension of shoulder 33. Consequently, in order for the thickness of side wall 24 to be substantially equal to the radial dimension of shoulder 33, it is important that the outside diameter of wall 46 and surface 38 be properly selected. Similar constraints are necessary if a raised bead is used in lieu of shoulder 33.

Wall 46 includes at its uppermost location a top rim portion 47 which defines the container opening. As should be understood, each of the male and female contoured portions existing both with the closure 20 as well as the container neck 21 are annular in appearance and uniform as to shape and dimensions throughout their 360° extent. Wall 46 has a very slight upward and inward taper as does closure 20, such that as closure 20 is pressed downwardly, the lower portion of side wall 24 does not encounter dimensional interference as it approaches shoulder 33. This assures that the closure will be easily started on the container and advanced. The fit becomes progressively tighter and tighter as the upper portions of the container and closure are pushed together. Once the closure is fully advanced onto the container neck, lower edge 32 will be adjacent shoulder 33 while at the same time rib 41 snaps over bead 34 as rim portion 47 pushes snugly up into channel 42. This manner of engagement actually provides two sealing locations, one at the upper portion of the container neck where the inside diameter of the rim portion seals against the inwardly tapering annular surface provided by portion **42*c* which actually fits into the container opening. The other seal location is at the intersection of bead 34 and rib 41. When the closure is pushed onto the neck of the container, the angled nature of portion 42*c* tries to push the inside diameter of the neck outwardly while the snap-on interference of rib 41 and bead 34 tends to hold the neck inwardly. These two opposing forces put a preload on the seal location of the neck inside diameter and portion 42*c***.

This tight engagement between these two members facilitates and furthers the tamper-evident objectives of the present design. If the closure was somewhat loosely received by the container neck, then there would be greater dimensional freedom for the purposes of flexing the closure in an attempt to pry it off of the container neck. However, by having tight engagement between the closure and the container neck, this option is not available to one who would attempt to tamper with the contents of the container. The snug fit and provided sealing also permits the present closure to be free of any liner which is often required to insure the requisite sealing.

As has been mentioned, one of the characteristics of the present invention which is believed to be important to its success is the increased axial height of the closure relative to its diameter. When evaluating the relationship between these dimensional values, the thickness and flexibility of the material used for the closure must also be taken into consideration. However, there is a limit on the types of materials which are suitable and thus in accordance with the teachings of the present invention, the axial height of closure 20 of the exemplary embodiment is at least one-half the outside diameter size of the closure. Of course, the greater the axial height, the greater the degree of security against unauthorized tampering. However, since the score lines must be severed to remove the closure, the greater the axial height the longer the score lines must be in order to allow a much larger portion of the closure to flare outwardly in order to release the closure from the container neck.

A further point to consider with the dimensional proportions of the closure is the fact that the bail handle 26 is designed to be pulled upwardly on and ultimately pass over the top edge of the closure so that it may be comfortably grasped by the fingers of one hand and lifted upwardly on in order to sever the score lines. Since it is also found to be important to dispose this bail handle at substantially the lowest-most point of the closure, if the axial height of the closure is greatly increased such as two or three times what it presently is relative to the diameter, then the bail handle would need a much larger diameter in order to be able to pass over the uppermost surface of the closure. Consequently, a number of factors have to be assessed in evaluating the dimensional relationships, but it should be understood that all other dimensional properties can be satisfactorily established by the 1:2 ratio between the height and the diameter as previously identified. All of these dimensional relationships are also only applicable to the snap-on type of container closure since threadedly engaged closures have an entirely different set of criteria and there would not under those types of designs be a desire or the option of pulling the closure off of the container neck by means of the bail handle. Rather, the closure would simply be unscrewed once any interlocking features or other tamper-evident features were defeated.

One option to the present invention is to provide a total of four score lines with one each being disposed on each side of each attachment rib. The decision as to the number and location of score lines depends in part on the size of the closure, its material, wall thickness and the desired force level to be exerted to remove the closure.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A flexible, plastic, snap-on closure for use in combination with a container in order to seal closed said container in a tamper-evident manner wherein the neck of the container is configured with a top rim portion defining a container opening, an outwardly opening annular channel disposed below said top rim portion, a generally cylindrical side wall and a shoulder providing a substantially horizontal abutment surface outward of said side wall and wherein said snap-on closure comprising:

a flexible closure body having a top surface and a generally cylindrical surrounding side wall;

an inwardly protruding annular rib;

an annular connecting portion disposed between said annular rib and said top surface and arranged to define an inwardly opening annular channel;

a bail handle attached to said surrounding side wall by means of two, spaced-apart attachment ribs integral with said bail handle, said side wall including a pair of score lines, each score line being disposed adjacent a corresponding attachment rib;

said annular rib being suitably configured to fit within said outwardly opening channel, and said inwardly opening annular channel being suitably configured to snugly receive said top rim whereby the snap-on receipt of the closure by the container creates a sealed and closed condition of the container by means of said snap-on closure; and said closure having an axial height which is sufficient relative to its diameter and material flexibility in order to prevent removal of said closure without some indication of said tampering being evident on the closure.

2. The snap-on closure of claim 1 wherein said inwardly opening annular channel has a part-circular cross-sectional shape and terminates with an inwardly tapered surface.

3. The snap-on closure of claim 1 wherein said closure's axial height is equal to at least one-half of the closure's outside diameter.

4. The snap-on closure of claim 1 wherein said bail handle is further attached to said closure by a plurality of frangible elements and the lowermost surface of said bail handle is substantially coincident with the lowermost edge of the closure.

5. A flexible, snap-on closure for use in combination with a container neck in order to seal closed the corresponding container in a tamper-evident manner, wherein said snap-on closure comprises:

a flexible closure body having a top surface and a generally cylindrical surrounding side wall;

a bail handle attached to said surrounding side wall by means of two, spaced-apart attachment ribs integral with said bail handle, said side wall including a pair of score lines, each score line being disposed adjacent a corresponding attachment rib; and said closure having an axial height which is sufficient relative to its diameter and material flexibility in order to prevent removal of said closure without some indication of said tampering being evident on the closure.

6. The snap-on closure of claim 5 wherein said closure's axial height is equal to at least one-half of the closure's outside diameter.

7. The snap-on closure of claim 5 wherein said bail handle is further attached to said closure by a plurality of frangible elements and the lowermost surface of said bail handle is substantially coincident with the lowermost edge of the closure.

8. In combination:

a container comprising:

a container neck portion which includes a top rim defining a container opening;

an outwardly opening annular channel disposed below said top rim;

a generally cylindrical side wall; and a shoulder providing a substantially horizontal abutment surface outward of said side wall; and a flexible, snap-on closure for use in combination with said container neck which comprises:

a flexible closure body having a top surface and a generally cylindrical surrounding side wall, an inwardly protruding annular rib;

an annular connecting portion disposed between said annular rib and said top surface and arranged to define an inwardly opening annular channel;

a bail handle attached to said surrounding side wall by means of two, spaced-apart attachment ribs integral with said bail handle;

said side wall including two opposite score lines, there being one score line disposed on opposite sides of each attachment rib;

said annular rib being suitably configured to fit within said outwardly opening channel, and said inwardly opening annular channel being suitably configured to snugly receive said top rim whereby the snap-on receipt of the closure by the container creates a sealed and closed condition of the container by means of said snap-on closure; and said closure having an axial height which is sufficient relative to its diameter and material flexibility in order to prevent removal of said closure without some indication of said tampering being evident on the closure.

9. The snap-on closure of claim 8 wherein said inwardly opening annular channel has a part-circular cross-sectional shape and an interior tapered wedge configuration.

10. The snap-on closure of claim 8 wherein said closure's axial height is equal to at least one-half of the closure's outside diameter.

11. The snap-on closure of claim 8 wherein the side walls of said container neck and said closure are cooperatively sized for an interference fit thereby creating a secondary seal.

12. The snap-on closure of claim 8 wherein said bail handle is further attached to said closure by a plurality of frangible elements and the lowermost surface of said bail handle is substantially coincident with the lowermost edge of the closure.

* * * * *